US005294100A

United States Patent [19]

Scheibelhut

[11] Patent Number: 5,294,100

[45] Date of Patent: Mar. 15, 1994

[54] METHOD AND APPARATUS FOR SECURING PLURAL PRINTED MATERIAL WITH PEELABLE TABS

[75] Inventor: Mark Scheibelhut, Janesville, Minn.

[73] Assignee: Brown Printing Company, Waseca, Minn.

[21] Appl. No.: 902,155

[22] Filed: Jun. 22, 1992

[51] Int. Cl.[5] ..... B65H 39/02; B65B 11/00; B65B 1/30

[52] U.S. Cl. ..... 270/54; 53/397; 53/493; 53/501

[58] Field of Search ..... 270/37, 53, 54, 58; 53/54, 501 X, 580, 493 X, 135.1, 139.7, 591, 593, 397; 414/788.1, 788.4, 789.6, 791

[56] References Cited

U.S. PATENT DOCUMENTS

| | | | |
|---|---|---|---|
| 4,167,476 | 9/1979 | Jackson | 414/789.9 X |
| 4,302,198 | 11/1981 | Kawada | 270/58 X |
| 4,426,072 | 1/1984 | Cole et al. | 270/53 |
| 4,589,946 | 5/1986 | Borrow | 53/580 X |
| 4,601,394 | 7/1986 | Hutner | 414/788.7 X |
| 4,617,784 | 10/1986 | Golicz et al. | 53/591 X |
| 4,685,993 | 8/1987 | Flaherty et al. | 53/135.1 X |
| 4,790,119 | 12/1988 | McDaniels | 53/493 X |
| 5,009,055 | 4/1991 | Simmons | 53/580 X |
| 5,025,608 | 6/1991 | Marchetti | 53/135.1 |
| 5,025,610 | 6/1991 | Graushar | 53/493 X |
| 5,214,901 | 6/1993 | Milliner | 53/580 X |

FOREIGN PATENT DOCUMENTS

| | | | |
|---|---|---|---|
| 414689 | 6/1966 | Switzerland | 270/53 |

*Primary Examiner*—Edward K. Look
*Assistant Examiner*—John Ryznic
*Attorney, Agent, or Firm*—Haugen and Nikolai

[57] ABSTRACT

An apparatus and method for forming and securing small-count stacks of plural printed documents for handling and mailing with peelable tabs which are applied to opposite sides of stacked plural documents. The apparatus is incorporated into an automated magazine binding production line to receive predetermined printed documents. The apparatus has a glue bead applicator for tacking a glue bead on the printed documents, a stacking station downstream of the glue station for stacking said plural printed documents, and a tabbing station downstream for creating tabs of the required length and then applying of the stacking station tabs on opposing sides of said stacked printed documents. The secured stack of printed documents is then conveyed to a sorting and mailing station.

33 Claims, 4 Drawing Sheets

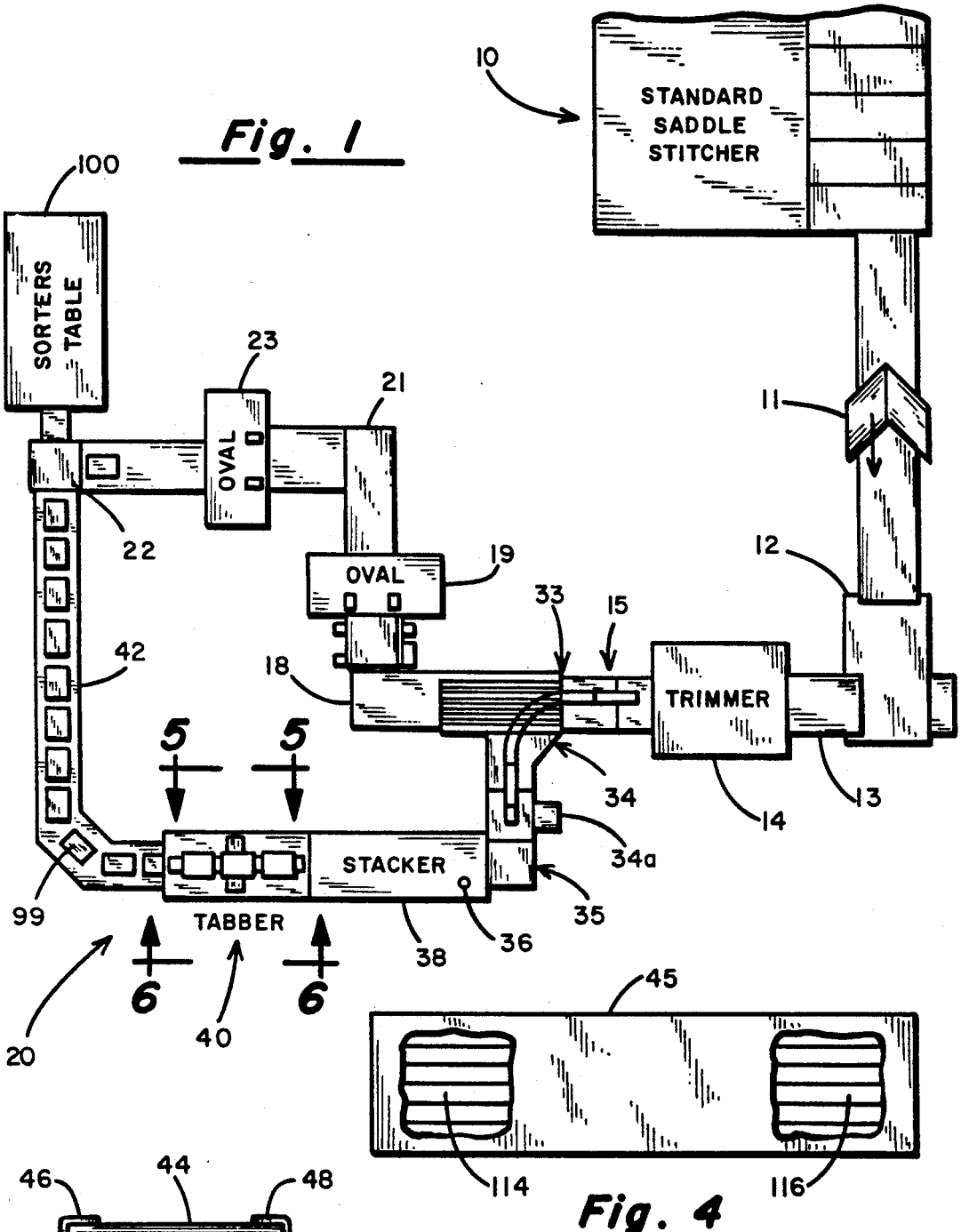
Fig. 1
Fig. 4
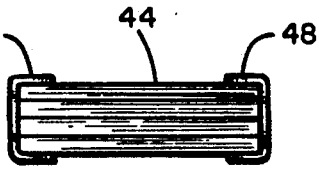
Fig. 3

METHOD AND APPARATUS FOR SECURING PLURAL PRINTED MATERIAL WITH PEELABLE TABS

BACKGROUND OF THE INVENTION

I. Field of the Invention

This invention relates generally to the formation of plural printed documents in stacked relationship for handling and mailing. More particularly, the invention pertains to a method and apparatus for securing stacked plural printed documents by utilizing adhesive tabs which wrap around the sides of the stacked plural printed documents and glue beads interposed among the stacked plural printed documents for maintaining the integrity of the stack during handling and mailing.

II. Background of the Invention

Magazines printed for distribution via the United States Postal Service (USPS) are typically addressed at the facility where the individual components are collated and bound to produce the magazine. The postage represents a significant portion of the overall production cost. The USPS regulations include a number of options which allow the publisher to reduce postage costs. These reductions are the driving force behind the magazine packaging which occurs at the printing plant. One such option relates to so called "firm packages" in which a plurality of documents such as magazines, catalogs, etc. are to be delivered to a single address.

In a typical magazine production process the magazine signatures are collated and then bound together. The complete magazines are then addressed either in-line with the collating and binding machinery or offline on an independent mail labeling line. After the magazines are labeled, they are stacked and then bound into packages. The package forming operation typically employs machinery which cross-ties and/or shrink-wraps the stack of magazines.

The formation of the packages is the point in the process when most of the postage cost reduction options are available. In the simplest case, the packages would be formed into constant size stacks with the address labels for the magazines in no particular order. This leaves the entire sorting effort to the post office and results in no discount. The discounts occur when the magazines are presorted according to the USPS regulations. The current practice results in varying size packages which include magazines that are destined for a particular city or zip code destination. At the finest presort level, magazines which are destined for the same address are packaged together. Such packages are referred to as "firm packages" by USPS definition. However, due to limitations with the existing packaging methods of cross-tying or shrink wrapping, small-count firm packages are not typically produced.

The usual minimum package size per USPS regulations is six magazines for second class mail, although USPS regulations can be met with smaller "firm" packages. The existing packaging equipment is only capable of forming packages of six or more at typical line speeds. The formation of firm packages of two to five magazines requires a maximum cycle rate which exceeds the current state of the art for stacking, cross-tying, and shrink wrapping equipment. Small-count packages also pose a problem for cross-tying or shrink wrapping because the small stack tends to curl up as the shrink wrap or cross-tie straps are applied.

In some instances, small-count firm packages are produced by slowing down the binding line. This results in cost increases for labor and binding line utilization, which quickly can negate any postage cost avoidance. The problem of curling is still present at the lower speeds.

An alternative application for the formation of packages occurs when a publisher wishes to mail some or all of their magazines with a renewal card, bill, advertising or editorial supplements referred to as "allowable enclosures" or "onserts". In this case a wrapper, envelope or polybag is used to contain the magazine onserts and the magazine. Polybags are typically applied offline because the polybagging process is slower than typical line speeds and it does not allow intermittent application of the polybag.

Therefore what is needed is a method and apparatus which can operate at typical line speed to form small-count firm packages and does not cause curling of the items to be packaged. The present invention forms packages, by the automated application of tabs, which are applied to opposite sides of a stack of plural printed documents. The tabs wrap around opposed edges of the stack and contact the top and bottom book in the stack. The tabs are held in place by a peelable adhesive. Small beads of peelable adhesive may also be placed between the magazines or onserts in the stack to prevent skewing or slipping of the magazines or onserts during handling and/or mailing.

SUMMARY OF THE INVENTION

The present invention is a method and apparatus for securing small-count firm packages without disrupting the operation of an automated magazine binding production line normally producing large-count stacks. While the invention is being described in the context of a magazine publishing application, it may also be adapted to other printed documents. As the magazines are conveyed through a conventional trimming station, past a labeler head and towards the portion of the line which forms and secures large-count stacks, those magazines required for small-count stacks (firm packages) are diverted to an adjacent parallel line incorporating the present invention. Once diverted, the magazines are conveyed to a short-count stacker. Just prior to being assembled into a stack, a hot-melt release glue applicator selectively tacks a peelable glue bead(s) onto a cover of each magazine to be stacked, except for the top one in the stack. The magazines are then stacked, via the stacker, and conveyed to a tabbing station.

The tabbing station has a first and second transfer belt conveyor between which lies opposed tab applicators. Each tab applicator has a source of tab substrate material which feeds up through two stepper motor driven tab feed wheels. The feed wheels draw the tab substrate material up until the desired length necessary for the particular firm package being assembled is reached. The tab substrate material is then cut to form a tab and the tab held in place by a vacuum shoe. A second hot-melt glue applicator applies the peelable glue onto the ends of the tab. The vacuum shoe rotates the tab and, with a properly timed blast of air, forces the ends of each tab against the top and bottom surface of the stack. The stack may then pass through a mechanical plow arrangement which completes the fold of the tabs onto the top or bottom surfaces of the stack. The stack then passes through upper and lower nip rollers for firmly securing the adhesive tabs to the package and the glue beads between each magazine to the opposing cover surfaces. The firm packages are then conveyed to the main lines sorting and mail stations where they are merged with the larger stacks in the original sequence.

In the alternative embodiment, the present invention remains inline upstream of the standard stacking and tying equipment and is directed to an onserting operation. The stacking station in the alternative embodiment consists of an onserting operation in which supplemental printed documents are deposited onto magazines as they move along a conveyor line. The onserts are secured to the magazines by the tabbing process and then the tabbed group is labeled and stacked in the conventional manner.

OBJECTS

The primary object of the present invention is to provide a method and apparatus for producing small-count packages at typical magazine binding line speeds.

Another object of the present invention is to provide a method and apparatus which eliminates curling of the stacked printed material in the small-count package.

Yet another object of the present invention is to provide a method and apparatus for securing onserts and "allowable enclosures" to printed materials with tabs instead of using an envelope, polybag, or paperwrap.

Still another object of the present invention is to provide a method and apparatus for forming and securing short-count packages which are less expensive than enveloping or polybagging.

Another object of the present invention is to provide a method and apparatus for forming and securing a "firm package", or onserts which are more acceptable to publishers sensitive to the negative environmental image associated with polybagging.

Still another object of the present invention is to provide a method and apparatus which allows intermittent operation of the packing forming process during continuous operation of the line incorporating the present invention.

Another object of the present invention is to provide a new method and apparatus for forming a small-count firm package which meets the USPS domestic mail manual regulations.

Another object is to provide a packaging concept which is compatible with USPS automated sorting equipment and the associated automation discounts as an alternative to polybagging which is excluded from current automation proposals.

DESCRIPTION OF THE DRAWINGS

These and other objects of the present invention will become more readily apparent from the following detailed description taken in conjunction with the accompanying drawings in which:

FIG. 1 is a schematic of a magazine saddle binding production line incorporating the present invention;

FIG. 3 is a plan view of a tab of the present invention;

FIG. 4 is an end view of a secured, small-count firm package;

DETAILED DESCRIPTION OF THE PREFERRED EMBODIMENT

Figure 2:
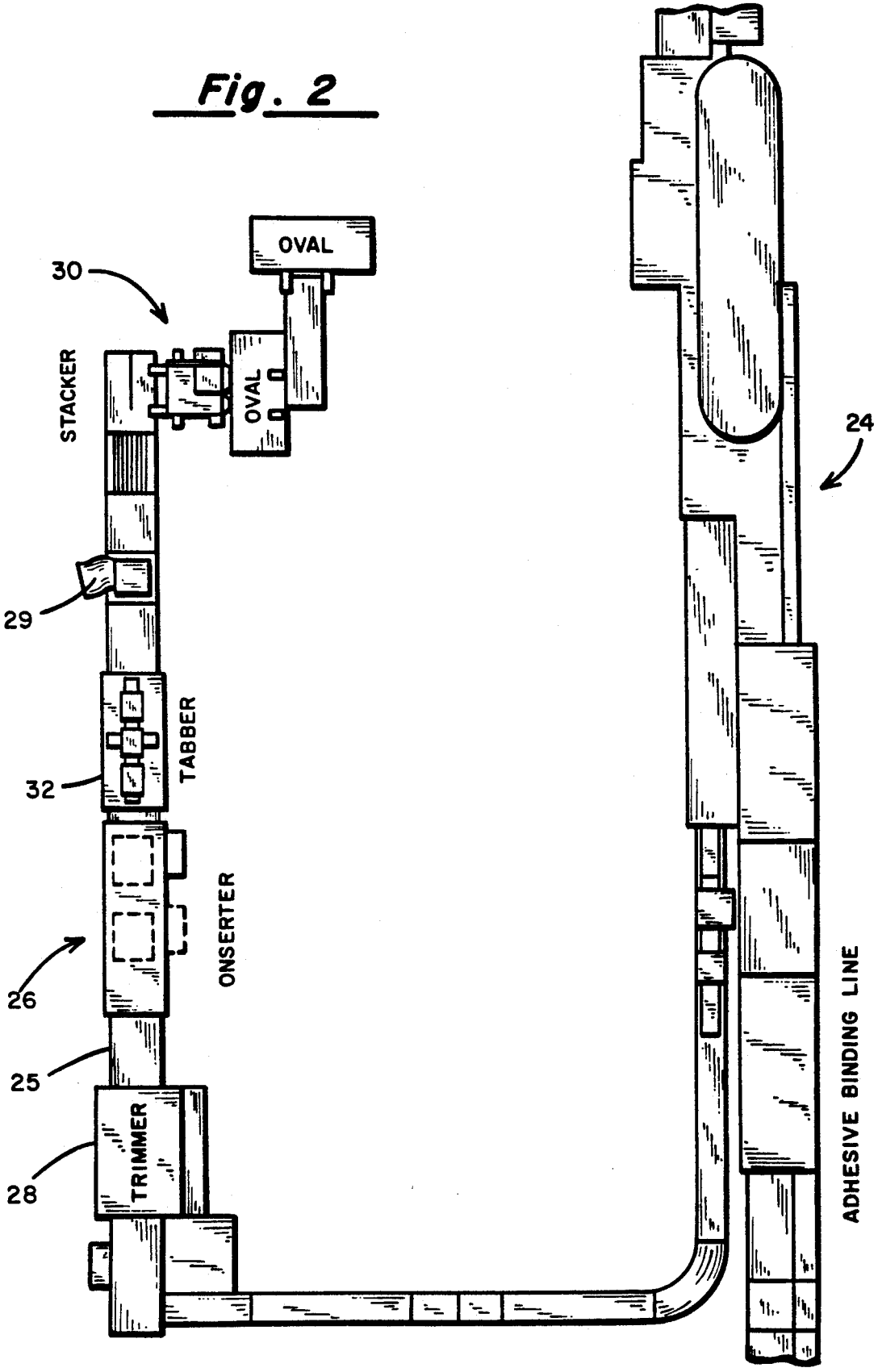
FIG. 2 is a schematic of an adhesive binding production line for magazines incorporating the alternative embodiment present invention.

The present invention comprises an apparatus and method for securing plural printed documents such as plural magazines or magazines and onserts in stacked relationship for handling and mailing. Typically, the plural printed documents are six or fewer magazines per stack, thereby forming a small-count firm packages, such as that term is used in Issue Number 14, dated May 15, 1992 of USPS Domestic Mail Regulations, or an onsert(s) on a magazine. The present invention may preferably be incorporated as an optional stacking and securing line in parallel arrangement with the typical stacking and securing line of an automated magazine binding production lines geared towards large-count stacks, which are typically secured by cross-tying and/or polybagging. FIGS. 1 and 2 are schematics which show two typical types of automated magazine binding production lines which include the invention.

FIG. 1 shows a conventional magazine binding production line indicated generally by numeral 10 and having a standard saddle stitcher 12, such as an A. M. Sheridan SP 855 saddle stitcher. The printed pages or signatures are bound at the standard saddle stitcher 12 into magazines. The magazines are then conveyed via conveyor 13 through a standard page trimmer 14, such as a HT 15 trimmer, and then past a standard labeler head 15, such as a Cheshire 539 or a standard ink jet printer such as the Video Jet 9416, which applies an address label under control of a system computer (not shown).

The next portion of the line contains stacking and securing means. It is here that the present invention is incorporated. Typically, the signatures are conveyed through to a standard stacking arrangement, such as a RIMA RS-12 counter stacker, designated generally 18, for forming large-count stacks of six or more magazines. The cross-tying process is next where the large-count stacks are tied in one direction at a first OVAL JP-80 tier 19, then are oriented via bump turn conveyor 21 so second OVAL JP-80 tier 23 ties the stack in a direction perpendicular to the first tie.

The present invention allows small-count stacks to be formed by diverting quantities of magazines from the main conveyor line to a parallel production line, designated generally as 20, operating at the same throughput as the main production line. The parallel production line 20 of the present invention forms and secures small-count stacks. This parallel production line then rejoins the main production line at 22 for the sorting and mailing portions of a typical magazine binding production line.

FIG. 2 shows an alternative embodiment of the present invention as applied to a typical adhesive binding production line, designated generally as 24. It includes an onserter apparatus 26. The onserter is located between the trimmer 28 and stacking portion of the line designated generally as 30. As mentioned above, the onserter 26 functions to position a bill, renewal notice, advertising or editorial supplement on top of each individual magazine or, in the case of a demographic system, on selected magazines in the stream which are to be routed to a particular subscriber or customer. The onserter line will also include a tabber station 32 that will secure this type of small-count package. After the onserts have been secured to the magazine, the composite is conveyed past labeling station 29 and toward the stacking and securing portion of the line. This portion of the line can include two parallel lines, one line for stacking large-count stacks and one line for small-count stacks which utilizes the present invention for the preparation of "firm" packages.

Referring again to FIG. 1, the apparatus comprising the present invention is found in a parallel line to the main production, and includes a diverter 33, a 90° turn conveyor 34, a reject divert station 34*a*, shuttle pocket 35, a stacking station 38, a tabbing station 40, and a second conveyor 42 for transferring the assembled and tabbed stacks to the sorter table on the main line. FIG. 3 shows a resulting small-count firm package 44 secured by tabs 46 and 48. FIG. 4 shows a typical tab 45 for securing the small-count package.

The apparatus comprising the present invention is connected to the main production line 10 by a conventional diverter 33 such as RIMA stacker infeed divert gate, and a 90° turn conveyor 34 allowing a predetermined number of printed documents to be extracted from the main production line 10 to the parallel line 20 of the present invention. Downstream from the 90° conveyor 34 is a first glue applicator 36. The first glue applicator is preferably a hot melt glue gun such as the Nordson Model H-20 which will apply hot melt releasable glue bead such as H. B. Fuller HM 2703 or pressure sensitive glue bead to the cover surface of selected magazines at a predetermined location thereon.

The 90° turn conveyor 34 leads to stacking station 38. The stacking station 38 orients a predetermined number of the magazines into a stacked relationship. The stacking station 38 preferably includes an ultra high speed short-count stacker. The stacker preferably should have a maximum stack capability of about 2½" and a nominal maximum stacker cycle rate of 150 stacks per minute. This will ensure that the parallel line of the present invention runs the same throughput as the main production line.

Figure 5:
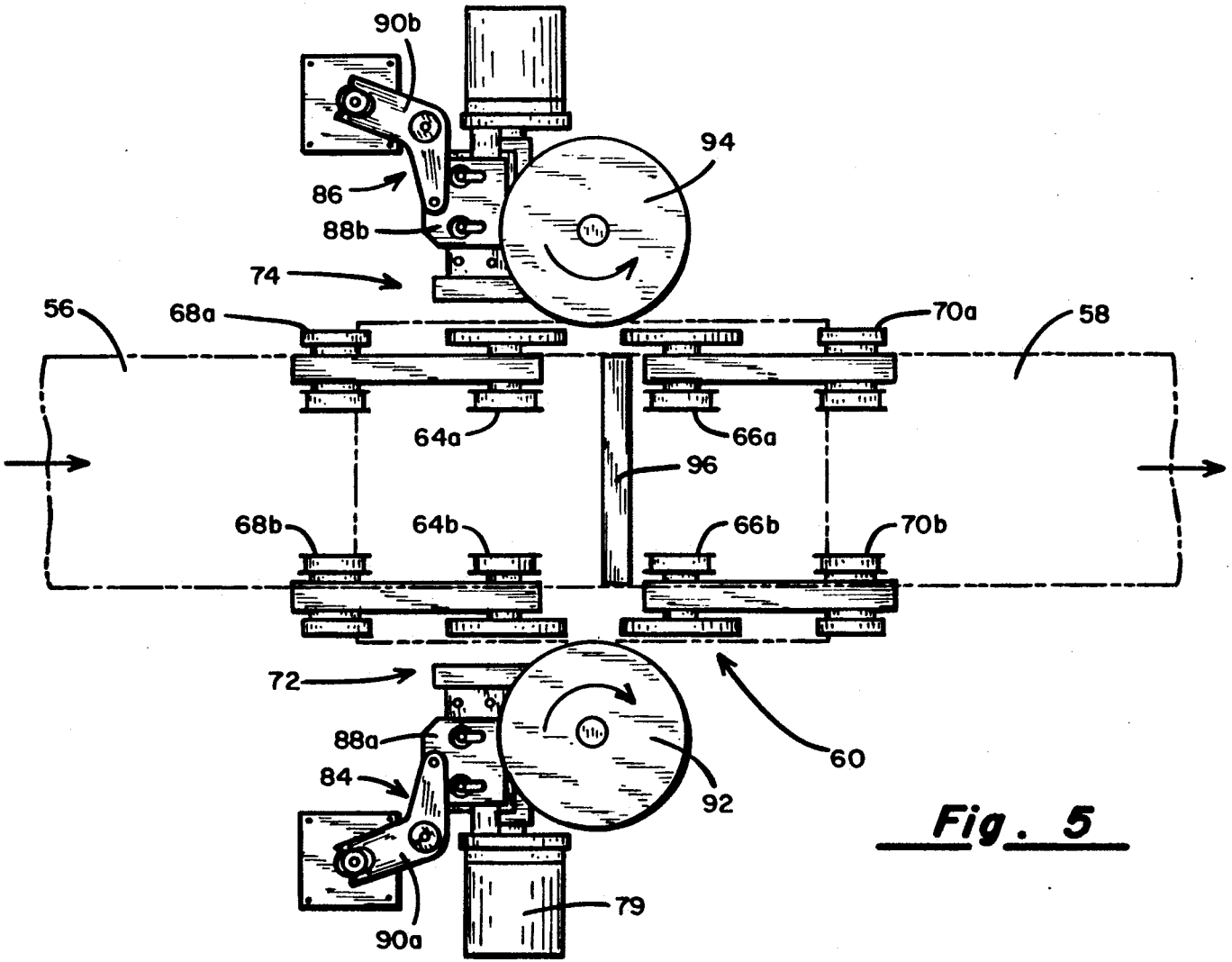
FIG. 5 is a plan view of the tabbing station of the present invention.
Figure 6:
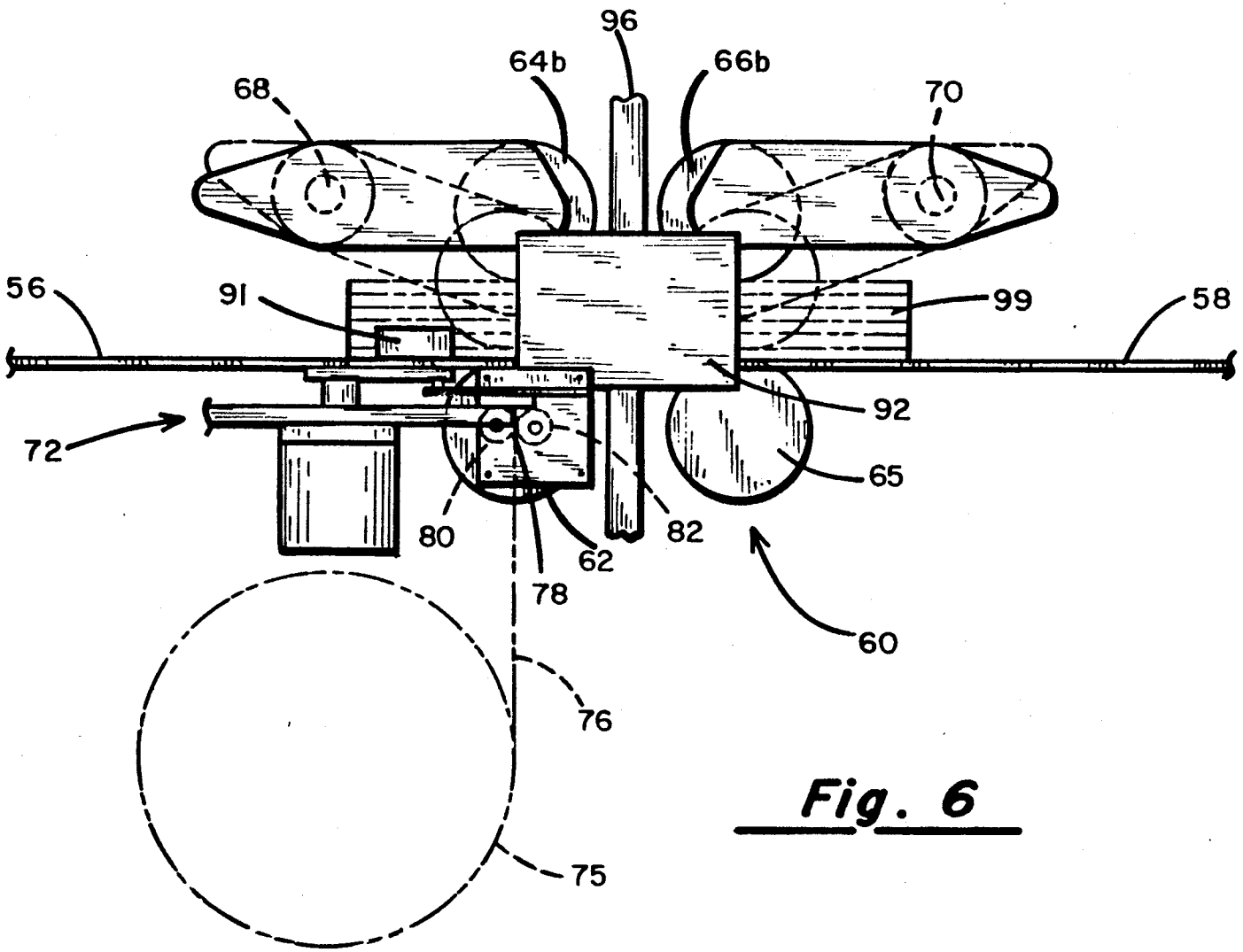
FIG. 6 is a side view of the tabbing station of the present invention.

The tabbing station 40, is located immediately downstream of the stacking station 38. Referring to FIGS. 5 and 6, the tabbing station 40 has two longitudinally disposed transfer belts 56 and 58 on either side of the tabbing area which is designated generally as 60. Between the first or upstream transfer belt 56 and the tabbing area 60 on a first side of the tabbing area is a first drive roller 62*a* with a cooperating adjustable roller 64*a*. A corresponding first drive roller 62*b* with a cooperating adjustable roller 64*b* is located between the second transfer belt 58 and the tabbing area 60 is a second drive roller one is shown in FIGS. 5 and 6 as 65, 65 with a cooperating adjustable roller 66*a*. The adjustable rollers 64*a* and 64*b* pivot about shaft 68*a* and 68*b*, respectively, and adjustable rollers 66*a* and 66*b* pivot about shafts 70*a* and 70*b*. This allows for variations in the height of the stack. FIG. 6 shows the positions of the adjustable rollers 64*b* and 66*b* in solid line for stack 99 broken line for the case when a single magazine with one or more onserts passes through the tabbing station.

As seen in FIG. 5, on either side of the tabbing area 60 are two identical tab feed devices 72 and 74. Each of the tab feed devices, as shown by tab feed 72, has a reel 75 loaded with an elongated strip of tab substrate material 76. This tab substrate material is preferably high tear paper or a fiber reinforced paper tape. The tab substrate material 76 in each tab feed device is threaded through a tab advancer 78 which is operatively connected to a stepping motor 79. Each of the tab advancers 78 consists of two cooperating punch rollers 80 and 82. Each tab feed device also has a tab cutter 84 and 86, respectively, which is disposed adjacent each source of tab substrate material for cutting the tab substrate material to form a tab of a predetermined length. Each tab cutter has a blade 88*a* and 88*b* at the end of swing arm 90*a* and 90*b*.

Also forming a part of each of the tabbing devices 72 and 74 is tab adhesive applicator, one being shown at 91 in FIG. 6, is located adjacent each tab cutter. The two applicators may comprise any suitable adhesive applicator such as a hot melt glue gun, Nordson H20 or equivalent which can selectively apply a peelable or other releasable glue onto the tab substrate material. The applicator can conveniently be either located below the tab cutter or above the tab cutter and must be able to apply beads of adhesive to the opposed portions of the tab as shown by numerals 114 and 116 in FIG. 4.

Each tab feed device also has a tab transfer means, which is preferably a tab feed vacuum wheel shown as 92 and 94 in FIG. 5. The vacuum wheels contains a vacuum manifold for drawing a vacuum on the tab to hold the tab during its positioning and an air jet for blasting air in order to transfer the tab to the stack to be tabbed.

The tabbing area 60 can also include a mechanical plow arrangement located at 96 although it is not necessary. The mechanical plow arrangement consists of a plow folding board which will fold the tab over the remaining side and surface of the stacked magazines after it has been airblasted onto the stack. This mechanical plow arrangement is located upstream of the second power roller 65 and corresponding adjustable roller 66. The second conveyor 42 located between the main production line 10 and at the tabbing station 40 transports the sidetracked tabbed firm packages back to the main production line.

In the alternative arrangement found in the production line shown in FIG. 2, the present invention includes glue applicator 25, a stacking station consisting, like first glue applicator 36 of the first embodiment, of an onserter 26 and a tabbing station 32. Glue applicator 25 may be any glue applicator which will deposit a releasable glue bead on a top surface of each magazine to receive an onsert. The onserter 26 is any conventional onserter such as a Sitma model 675 which places an onsert on the top of a magazine. The tabbing station 32 has the same features as tabbing station 40 discussed above.

MODE OF OPERATION

The present invention is incorporated into the automated main magazine binding production line 10 and will receive predetermined select magazines for forming small-count packages as explained below. In the typical automated microcomputer controlled magazine production binding line 10, the collated group of signatures, one is shown at 11, in FIG. 1, or a perfect binding line 24, as shown in FIG. 2, to a standard trimmer 14 for trimming the signatures so that the edges of the magazines will be regular. The trimmed magazines or other printed documents, are then conveyed thru a labeling station and then to either the stacking station 18 on the main production line 10 or diverted to the apparatus of the present invention on the parallel line 20. The magazines not diverted continue through a stacking station 18 and are cross-tied or shrink wrapped or removed to an off-line process. These non-diverted magazines then continue to a sorting and mailing station 100.

When small-count firm packages are to be formed, the computer control channels the requisite magazines from production line shown in FIG. 1, by means of diverting mechanism 33 and 90° turn conveyor 34. The magazines are conveyed through the first glue station 36. The glue station contains a glue applicator which applies a spot or bead of preferably peelable or releasable glue on the top surfaces of the magazines, except on the magazine which will be on the top of the stack. The predetermined number of magazines then enter the stacking station 38 where a stacker will stack the predetermined number into a small-count stack of six or fewer magazines. The glue beads are now disposed between the magazines to help secure the stack.

The stacked magazines are now conveyed to the tabbing station 40. Two stepping motors, also controlled by the main computer, drive the tab feed cooperating punch rollers 80 and 82 drawing up the tab substrate material to the necessary length for securing the stacked magazines. Once the desired length is reached, the tab substrate material is cut by the tab cutters 84 and 86 to form the tab. The adhesive is also applied to the tab after the tab is cut, depending upon whether the first and second tab adhesive applicators are located above or below the tab cutter. These adhesive applicators preferably apply the glue on the portion of the tab which will be facing the top and bottoms surfaces of the stacked magazines. FIG. 4 shows tab 45 partially broken away with adhesive coated areas 112 and 114.

When the tabbed substrate material is fed up through the tab feed 72 and 74 on both sides, a vacuum is drawn on the tab by vacuum wheels 92 and 94. When the tab substrate material is cut, the tab remains in its position. Vacuum wheels 92 and 94 rotate approximately 45 degrees placing the tabs adjacent opposing sides of the stack, at which time an air jet transfers the tabs against the opposed side edges of the stack. The air jet forces the ends of the tab to adhere to the top and bottom surface. The stack is then conveyed through the mechanical plow 96 which completes the fold of the tabs onto the top and bottom of the stack. The stack is then conveyed through rollers 64*a*, 64*b*, 66*a* and 66*b* which presses the tabs to the top and bottom surfaces to more firmly bond the tabs to the top and bottom magazines. The glue beads located between the magazines are also pressed to further secure the stack and prevent skewing of the stack. The now secured stack, one is shown at 99, is conveyed back to the main production line 10 where it can be sent to the sorting station 100.

Both the conventionally produced large stacks and the smaller stacks produced by this invention are tracked thru their respective processes by the tabbing line computer controller. At the merge point 22 the arriving stacks are gated such that the original stack sequence is regained.

The process is similar when the invention is associated with an automated magazine production line utilizing an onserter shown in FIG. 2. After the trimming station 28, the magazine is passed through a first glue station 25 where a hot melt adhesive glue bead may be tacked to the upper surface of the magazine. The magazine is then conveyed to the onserter 26 where the onsert is positioned on the top surface of the magazine and the glue bead is now located between the magazine and onsert. The magazine is then sent to the tabbing station 32 and the process of applying the tabs described above is the same. Once the onsert is secured to the magazine by the tabs, it is then conveyed past a labeling station 33 to the stacking portion of the magazine binding line where it can enter either the main line stacking station or be diverted to the present invention if it is to form a small-count package.

It is understood that the above disclosure and presently preferred embodiment is to be taken as illustrative of the invention. The invention may be readily adapted to secure a variety of plural printed documents in stacked relationship. Furthermore, it is to be understood that those skilled in the art be capable of making modifications.

I claim:

1. An apparatus for securing plural printed documents in stacked relationship for handling and mailing comprising:

(a) an endless conveyor belt for conveying printed documents therealong;

(b) a stacking station fed by said endless conveyor belt for stacking said plural printed documents one atop the other; and (c) a tabbing station downstream of said stacking station, said tabbing station including means for affixing selectively removable adhesive coated tab substrates to a stack of plural printed documents to thereby retain said documents in stacked relation during handling and mailing.

2. The apparatus of claim 1 and further including a first glue applicator disposed adjacent said endless conveyor belt for applying an adhesive bead to a first surface of said printed document, said first surface oriented parallel to said conveyor belt.

3. The apparatus for securing plural printed documents in stacked relationship for handling and mailing of claim 1 wherein said stacking station includes a short-count stacker having a maximum stack capability of about 2" to 2½" and a nominal stacker cycle rate in the range of from 90–150 stacks per minute.

4. The apparatus of claim 1 wherein said plural printed documents in stacked relationship comprises a "firm package" as defined in Issue Number 14, dated May 15, 1992, of U.S. Postal Service Domestic Regulations.

5. The apparatus of claim 1 wherein said plural printed documents in stacked relationship comprises at least one onsert on a magazine.

6. An apparatus for securing plural paged printed documents in stacked relationship for handling and mailing comprising:

(a) an endless conveyor belt for conveying printed documents therealong;

(b) a first glue applicator disposed adjacent said stacking station for selectively applying an adhesive bead on said plural paged printed documents;

(c) a stacking station fed by said endless conveyor belt for stacking said plural printed documents one atop the other, the top and bottom surfaces of a stack comprising opposed sides of said stack;

(d) a tabbing station downstream of said stacking station, said tabbing station including means for affixing adhesive coated tab substrates to a stack of plural printed documents to thereby retaining said documents in stacked relation during handling and mailing, said tabbing station having:

1. first and second longitudinally spaced transfer belts defining a tabbing area therebetween;

2. first and second tab feed means located on opposing sides of said transfer belts in said tabbing area, each said tab feed means having (i) a source of tab substrate with means for selectively advancing said tab substrate along a predetermined path; (ii) a tab substrate cutter means located between said source of tab substrate and said tabbing area for cutting said substrate into predetermined lengths; (iii) a tab adhesive applicator located adjacent said tab substrate cutter for applying adhesive to said tab substrates;

3. means for transferring tab substrates from said tab feed means to said tabbing area;

4. means for wrapping said adhesive coated tab substrate on opposing sides of said stacked plural printed documents, said means for wrapping located in said tabbing area downstream of said first and second tab feed means;

5. means for pressing a first and a second adhesive coated tab substrate on said opposed sides of said stacked plural printed documents, said pressing means located adjacent said second transfer belt.

7. The apparatus of claim 6 wherein said means for wrapping includes a mechanical plow folding board.

8. The apparatus of claim 6 wherein said means for pressing includes a roller operatively connected to a power source and an adjustable nip roller cooperating with said drive roller.

9. The apparatus of claim 6 wherein said means for wrapping includes an air jet.

10. The apparatus of claim 6 wherein said means for transferring comprises a rotary vacuum shoe device having a rate of one revolution per stack of plural printed documents entering said tabbing area.

11. The apparatus of claim 6 wherein said tab substrate is a high tear resistance material.

12. An apparatus of claim 6 wherein said first glue applicator and said tab adhesive applicators apply a peelable adhesive.

13. The apparatus of claim 6 wherein said tab substrate advancing means is a stepping motor.

14. An apparatus for securing plural printed documents in stacked relationship for handling and mailing and for use with a magazine binding production line comprising:

(a) means for diverting a predetermined number of said printed documents from said magazine production line to a first conveyor;

(b) a first glue applicator downstream from said production line adjacent said first conveyor for applying a bead of pressure sensitive glue to a surface of said documents;

(c) a stacking station downstream from said first glue applicator and said first conveyor for orienting said predetermined number of said printed documents in stacked relation;

(d) a tabbing station downstream of said stacking station for adhering adhesively coated tabs around opposed side edges of the stacked document; and (e) a second conveyor located downstream of said tabbing station for returning the stack of plural printed documents to said magazine binding production line.

15. An apparatus for securing plural printed documents in stacked relationship for handling and mailing of claim 14 wherein said pressure sensitive glue comprises a hot melt, release glue bead.

16. An apparatus for securing plural printed documents in stacked relationship for handling and mailing of claim 14 wherein said stacking station includes a short-count stacker having a maximum stack capability of 2" to 2½" and a maximum stacker cycle rate of 90–150 stacks per minute.

17. An apparatus for securing plural printed documents in stacked relationship for handling and mailing of claim 14 wherein said plural printed documents in stacked relationship comprises a "firm package" as defined in Issue Number 14, dated May 15, 1992 of the U.S. Postal Service Domestic Mail Regulations.

18. An apparatus for securing plural printed documents in stacked relationship for handling and mailing of claim 14 wherein said plural printed documents in stacked relationship comprises at least one onsert on a magazine.

19. An apparatus for securing plural printed documents in stacked relationship for handling and mailing of claim 14 wherein said tabbing station comprises:

(a) first and second longitudinally disposed transfer belts with a tabbing area therebetween;

(b) first and second rolls of tab substrate material located on opposing sides of said tabbing area;

(c) a stepping motor operatively connected to each said first and second rolls for selectively advancing said tab substrate material to a predetermined length;

(d) first and second tab cutters located adjacent each said rolls, said tab cutters cutting said tab substrate material into predetermined lengths;

(e) second and third glue applicator located adjacent each said tab cutter for applying an adhesive to the lengths of tab substrate material;

(f) means for transferring the lengths of tab substrate material located adjacent said tabbing area onto opposing sides of said stacked plural printed documents;

(g) plow means with a first end adjacent said means for transferring said tabs, said plow means for folding said lengths of tab substrate material about opposing sides of said stacked plural printed documents; and (h) a lower drive roller adjacent a second end of said plow arrangement belt and corresponding adjustable nip roller located above said driven lower roller for pressing said lengths of tab substrate material about opposing sides.

20. An apparatus for securing plural printed documents in stacked relationship for handling and mailing of claim 19 wherein said tab transfer means is a vacuum wheel having a rate of one revolution per stacked plural printed documents.

21. An apparatus for securing plural printed documents in stacked relationship for handling and mailing of claim 19 wherein said tab substrate is a high tear resistance material.

22. An apparatus for securing plural printed documents in stacked relationship for handling and mailing of claim 19 wherein said first, second and third glue applicators apply a peelable adhesive.

23. A method for forming and securing plural printed documents in stacks handling and mailing comprising the steps of:

(a) conveying said plural printed documents to a stacking station;

(b) stacking said plural printed documents one atop of the other;

(c) conveying said stacked plural printed documents to a tabbing station;

(d) applying a selectively removable adhesive tab on opposing side edges of said stacked plural printed documents; and (e) repeating steps a–d for forming and securing additional stacks of plural printed documents.

24. A method for forming and securing plural printed documents in stacks for handling and mailing said method comprising the steps of:

(a) conveying said plural printed documents to a stacking station;

(b) stacking said plural printed documents one atop of the other with the resulting stack having top and bottom exposed surfaces;

(c) conveying said stacked plural printed documents to a tabbing station;

(d) applying a selectively removable adhesive tab to said stack with a portion of said tab adhering to said top and bottom exposed surfaces of said stacked plural printed document so as to bridge the side edges of intermediate ones of said stacked printed documents;

(e) selectively applying a bead of glue on one of said to and bottom exposed surfaces of said stack at a first glue station; and (f) repeating steps a–e for forming and securing additional stacks of plural printed documents.

25. A method for forming and securing plural printed documents in stacks for handling and mailing said method comprising the steps of:

(a) conveying said plural printed documents to a stacking station;

(b) stacking said plural printed documents one atop of the other at said stacking station;

(c) conveying the stacked plural printed documents to a tabbing station;

(d) applying an adhesive tab to an exposed upper and lower surface of said stacked documents and bridging the side edges of intermediate plural printed document in said stack by:

1 feeding tab substrate material from a supply;

2 cutting said tub substrate material to a predetermined length;

3 applying a pressure sensitive peelable adhesive to said tub substrate material;

4 placing the tab of step 3 on a portion of opposing side edges of said stacked plural printed documents;

5 folding said tabs to engage said exposed upper and lower surfaces of said stacked plural printed documents;

6 pressing said tabs to said stacked plural printed documents; and (e) repeating steps a–d for forming and securing additional stacks of plural printed documents.

26. The method for securing plural printed documents in stacked relationship for handling and mailing of claim 24 wherein said plural printed documents comprise a firm package.

27. A method for securing plural printed documents in stacked relationship for handling and mailing of claim 24 wherein said plural printed documents in stacked relationship comprise at least one onsert on a magazine.

28. The method of claim 25 wherein placing said tabs on opposing sides of said stacked plural printed documents comprises the steps of:

(a) providing a rotating vacuum shoe;

(b) applying a vacuum on said tab;

(c) rotating said vacuum shoe to a desired location and carrying said tab therewith; and (d) airblasting said tab to transfer said tab to a portion of said side edge of the stacked plural printed documents.

29. A method for securing a predetermined number of printed documents in stacked relationship for handling and mailing for use in combination with a main line conveyor for a magazine binding production line comprising the steps of:

(a) periodically diverting a predetermined number of said documents onto a parallel line;

(b) conveying said predetermined number of printed documents on said conveyor to a first glue station;

(c) tacking a bead of glue on selective areas of said predetermined number of printed documents;

(d) conveying said predetermined number of printed documents to a stacking station;

(e) stacking said predetermined number of printed documents with said beads of glue therebetween;

(f) conveying the stacked predetermined number of printed documents to a tabbing station;

(g) adhesively bonding a tab to exposed top, bottom and intermediate side edges of said stacked predetermined number of printed documents;

(h) returning said stacked predetermined number of printed documents to said main line conveyor;

(i) repeating steps a–h for forming and securing additional predetermined number of printed documents in stacked relationship.

30. The method for securing predetermined number of printed documents in stacked relationship for handling and mailing of claim 29 wherein said predetermined number of printed documents in stacked relationship comprise a firm package as defined by U.S. Postal regulations.

31. A method for securing predetermined number of printed documents in stacked relationship for handling and mailing of claim 29 wherein said predetermined number of printed documents in stacked relationship comprise at least one onsert on a magazine.

32. A method for securing a predetermined number of printed documents in stacked relationship for handling and mailing of claim 29 wherein applying said tabs comprises the steps of:

(a) feeding tab material to a desired length;

(b) cutting said tab material to make a tab;

(c) applying a peelable adhesive to said tab;

(d) placing said tabs on a portion of opposing side edges of said stacked predetermined number of printed documents;

(e) folding said tabs over onto the opposed major surfaces of said stacked predetermined number of printed documents; and (f) pressing said tabs to said stacked predetermined number of printed documents.

33. The method of claim 32 wherein placing said tabs on opposing sides of said stacked predetermined number of printed documents comprises the steps of:

(a) applying a vacuum on said tab;

(b) moving said tab to desired location;

(c) airblasting said tab to apply said tab to a horizontal of opposing side edges of said stacked predetermined number of printed documents.

* * * * *

UNITED STATES PATENT AND TRADEMARK OFFICE

CERTIFICATE OF CORRECTION

PATENT NO. : 5,294,100

DATED : March 15, 1994

INVENTOR(S) : Mark Scheibelhut

It is certified that error appears in the above-identified patent and that said Letters Patent is hereby corrected as shown below:

In column 11, line 23, the phrase

"to and bottom exposed surfaces"

should read

-- top and bottom exposed surfaces --;

In column 11, line 44, the phrase

"said tub substrate material;"

should read

-- said tab substrate material; --

Signed and Sealed this

Twenty-sixth Day of July, 1994

Bruce Lehman

*Attest:*

BRUCE LEHMAN

*Attesting Officer*

*Commissioner of Patents and Trademarks*